United States Patent [19]

Roberts

[11] 4,386,794

[45] Jun. 7, 1983

[54] SKATING VELOCIPEDE APPARATUS

[76] Inventor: Hermand Roberts, 3941 S. Halldale Ave., Los Angeles, Calif. 90062

[21] Appl. No.: 863,933

[22] Filed: Dec. 23, 1977

[51] Int. Cl.[3] ..... A63C 3/04; A63C 17/28

[52] U.S. Cl. ..... 280/826; 280/11.2; 280/11.26; 280/11.28; 297/211

[58] Field of Search ..... 280/826, 11.2, 11.26, 280/87.04 A, 11.28, 8, 16; 297/211, 212

[56] References Cited

U.S. PATENT DOCUMENTS

| | | | |
|---|---|---|---|
| 646,919 | 4/1900 | Ross | 297/211 |
| 1,304,331 | 5/1919 | Leicht | 280/8 |
| 1,535,461 | 4/1925 | Frevert | 280/826 |
| 1,585,160 | 5/1926 | Lowell et al. | 280/826 |
| 1,985,726 | 12/1934 | Heldman | 280/826 |
| 3,224,785 | 12/1965 | Stevenson | 280/11.2 |
| 3,421,773 | 1/1969 | Pearson | 280/826 |

FOREIGN PATENT DOCUMENTS

| | | | |
|---|---|---|---|
| 418773 | 9/1925 | Fed. Rep. of Germany | 280/826 |

*Primary Examiner*—David M. Mitchell
*Assistant Examiner*—Milton L. Smith

[57] ABSTRACT

A skating velocipede apparatus to facilitate skating propulsion of a skater along a smooth, hard underlying ground surface while in a seated position taking the form of a longitudinal support member having wheels at the rear, a handle at the front end, a seat at an intermediate location, and a thigh-receiving abutment positioned shortly forwardly of the seat whereby to make it possible for a skater having skates fastened to each of his shoes to sit down on the intermediately positioned seat and move his thighs forwardly until they forcibly strike the thigh-receiving abutment while he places his hands on the front-positioned handle and leans back so that the rear positioned wheels will be forced downwardly into rolling contact with the underlying hard ground surfaces. It will be understood that the skater will be appropriately supported on the seat and yet will be in a position such that he may use each leg independently in a conventional skating action, which will propel him forwardly on the hard underlying ground surface while remaining seated on the seat. The extreme rear end of the longitudinal support member is also provided with removeably interchangeable frictional brakes which makes it possible to readily apply the brakes by merely pulling up on the front-positioned handle, thus forcing a removeable frictional braking element downwardly into frictional contact with the hard underlying ground surface.

9 Claims, 12 Drawing Figures

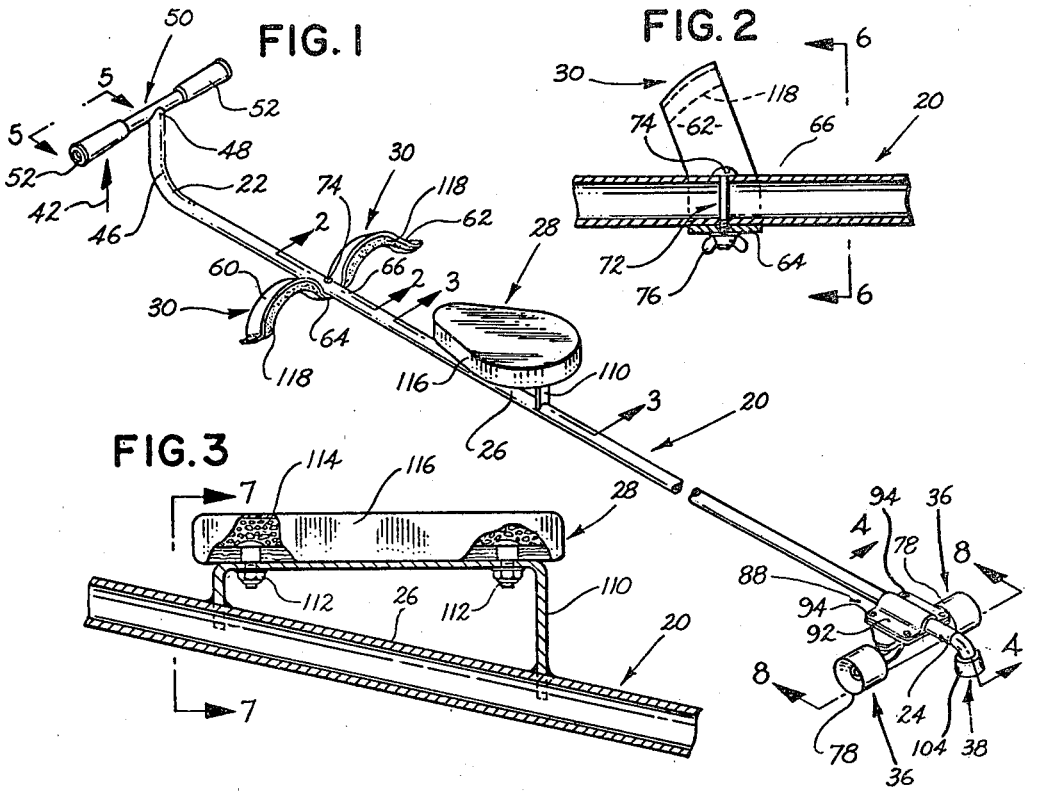
FIG. 1
FIG. 2
FIG. 3
50
5
52
48
22
42
46
30
74
118
62
66
2
60
64
28
3
116
110
26
20
6
72
76
114
112
7
94
36
4
78
8
88
92
24
104
38
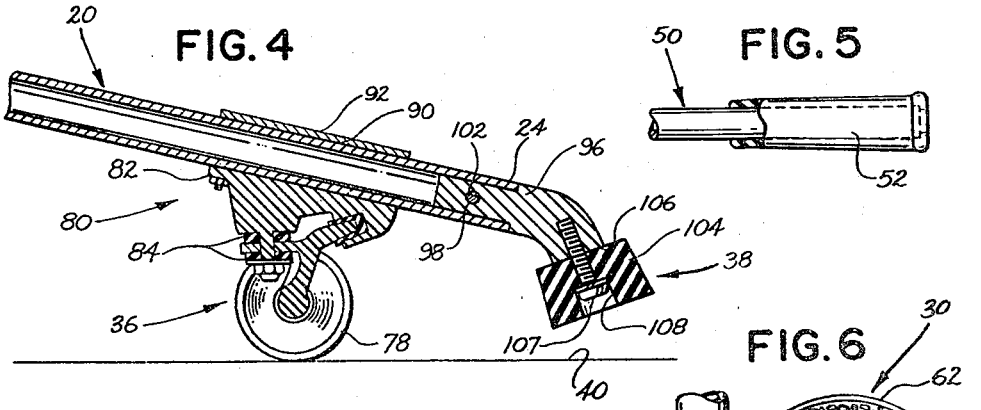
FIG. 4
FIG. 5
20
92
90
102
24
96
82
80
84
98
106
104
38
36
78
107
108
40
50
52
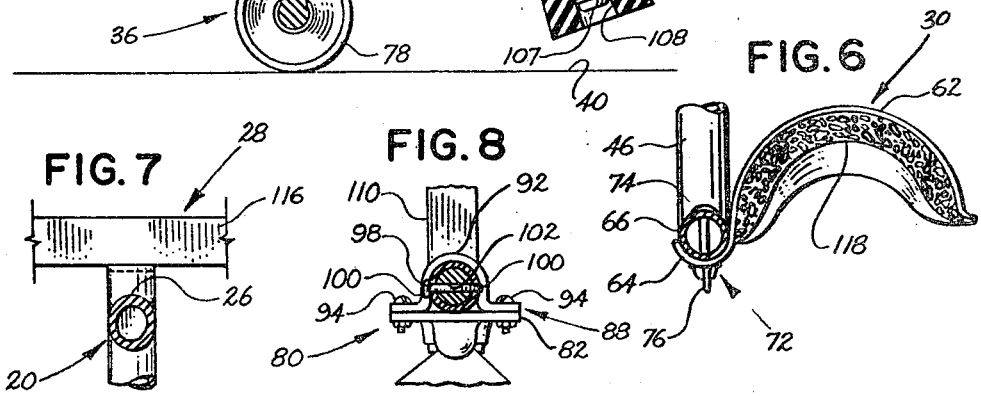
FIG. 6
FIG. 7
FIG. 8
30
62
46
74
66
118
64
76
72
28
116
26
20
110
92
98
102
100
94
88
82
80

-32-
-40-

SKATING VELOCIPEDE APPARATUS

BACKGROUND OF THE INVENTION

The field of the invention is generally that of velocipedes and corresponding wheeled vehicles or conveyances such as scooters, bicycles, tricycles, skates, skateboards and the like, all of which have different types of advantages and disadvantages. For example, a very high rate of speed and considerable maneuverability and control can be achieved while riding a bicycle. However, a bicycle is relatively expensive, bulky and also weighs a substantial amount and thus is difficult to transport from one location to another except by riding same. On the other hand, a skateboard and roller skates are relatively inexpensive, but are rather difficult to properly maneuver and control and are somewhat dangerous. They also require a substantial expenditure of effort at all times, and it is not possible to sit down or rest at all while propelling oneself on such prior art devices. It is obvious that it would be highly desirable to provide a relatively inexpensive, light-weight, readily transportable velocipede device which would allow a rider to attain considerable speed of movement while lending itself to easy control and braking and which, at the same time, is of relatively safe, easily operated construction. It is precisely such a highly desirable and advantageous type of simple, inexpensive, easy-to-operate, easy-to-control, relatively high-speed velocipede device which is provided by and in the present invention, and which has advantages virtually completely overcoming the above-mentioned prior art problems, disadvantages and limitations and all of which advantages flow from and occur by reason of the specific features of the invention pointed out hereinafter.

SUMMARY OF THE INVENTION

Generally speaking, the skating velocipede apparatus comprises what might be termed a structurally strong framework means which, in one preferred form, comprises at least one longitudinal support member of high strength, usually high-strength steel construction (although not specifically so limited) having a front end and a rear end and an intermediate seat-supporting portion positioned therebetween (and, in one preferred form, somewhat closer to the front end than to the rear end, although not specifically so limited in all forms of the invention). The intermediate seat-supporting portion is provided on an upper side thereof (upper side as it is positioned when in use) with seat means for a skater who is operating the skating velocipede apparatus to sit upon. The longitudinal support member is provided forwardly of the intermediate seat-supporting portion with transversely extending thigh-receiving, thigh-abutment means adapted to receive forward portions of the upper surface of the thighs of a skater who is seated on the seat means in in a manner such that force is adapted to be exerted by the skater's thighs upwardly and forwardly against the thigh-abutment means while force is exerted downwardly relative to said support member by the weight of the skater resting upon the seat means, thus effectively applying a force couple to the longitudinal support member, which thus may be said to effectively comprise and to function as an effective lever means, with said thigh-abutment means being said to comprise and to effectively function as an effective fulcrum means, and with said rear end being adapted to be forced downwardly as a result of said force couple and to effectively comprise, and effectively function as, what might be termed an output end of the effective lever means.

In a preferred form of the invention, the front end of the longitudinal support member is provided with manually graspable handle means for use in forcibly performing an uplifting manual braking action when desired and, alternatively, for use in facilitating the steering of the apparatus by manually thereto applying torque around a longitudinal axis of rotation substantially coincident with the longitudinal axis of the longitudinal support member whereby to cause tilting of the thigh-abutment means, the seat means, and the rear-positioned downwardly projecting wheel means in a turning manner which facilitates the easy turning of the entire device in any desired manner under the complete control of a skater operating same.

One preferred form of the invention includes brake means carried by the rear end of the longitudinal support member at a location rearwardly displaced beyond the downwardly projecting wheel means whereby to be controllably effectively pivotally moveable downwardly into forced braking contact with an underlying, smooth, hard ground surface whenever the front end of said longitudinal support member is forcibly manually lifted upwardly in a manual braking action, thus the previously mentioned force-couple provided at the output end (rear end) of the effective lever means is the force for causing the operating of said brake means when enhanced by the previously mentioned upward manual lifting of the front end of the longitudinal support member (usually through the use of the manually graspable handle means in the preferred form of the invention provided with same).

In one preferred form of the invention, the thigh-receiving and thigh-abutment means comprises a rearwardly and downwardly flat-surfaced, convoluted structural member having a left downwardly and rearwardly concave portion, a right downwardly and rearwardly concave portion and a centrally positioned upwardly concave portion adapted to receive therein an attachment portion of said longitudinal support member, and with both of the same being provided with alignable aperture means and threaded fastener means for firmly attaching said thigh-abutment means to said attachment portion of said longitudinal support member.

In another preferred form of the invention, the thigh-receiving and thigh-abutment means may take a slightly different form comprising a rearwardly and downwardly flat-surfaced, multi-curved bar member having a left downwardly and rearwardly concave portion, a right downwardly and and rearwardly concave portion, and an intermediate connection portion provided with an at least partial connection ring adapted to be effectively threaded onto said longitudinal support member and moved to a selected attachment location closely encircling an attachment portion thereof and being provided with controllably operable locking means for firmly locking said connection ring relative to said attachment portion of said longitudinal support member at a proper thigh-receiving effective fulcrum location.

In a preferred form of the invention, the downwardly projecting wheel-means comprises a pair of roller-bearing-mounted, laterally spaced, horizontally axially rotatively positioned skate wheel means provided with and attached to a mounting attachment truck-bracket means, and further provided with an upper attachment bracket lying over the top of a rear portion of said longitudinal support member and effectively defining, with said attachment truck-bracket means positioned immediately therebelow, a constrictible longitudinal receiving clamping sleeve means having said rear portion of said longitudinal support member extending therethrough and provided with an adjustable fastening means for firmly fastening said upper and lower clamping sleeve means and attachment truck-bracket means together and firmly locked onto said rear portion of said longitudinal support member with said wheel means projecting downwardly therefrom.

In one preferred form of the invention, the brake means is effectively provided with a controllably engageable and disengageable attachment means comprising a telescopic engaging member adapted to be telescopically engaged (either externally or internally) with the extreme rear end of said longitudinal support member (which is hollow and provided with a receiving bore hole at said rear end) and further provided with controllably fastenable locking means for removably fastening said attachment means in locked relationship.

In one preferred form of the invention, the brake means attachment means is provided with a frictional braking element removably attachable in a downwardly facing position with respect to the engaging member and is provided with a controllably fastenable and unfastenable fastening means for same for facilitating the ready removal and interchanging of the frictional braking element after it has become excessively worn from repeated braking engagements against an underlying hard ground surface. In one preferred form, the fastening means may comprise a countersunk threaded fastener member, such as a threaded screw or the like, for fastening the frictional braking element to the engaging member.

In one preferred form, an intermediate seat-supporting portion of the longitudinal support member is provided with a seat-supporting attachment bracket fastened thereto and having spaced attachment means adapted to underlie the seat means and effectively provided with attachment means for fastening the seat means thereto. In one form of the above mentioned seat-supporting structure, it may comprise a symmetrically transversely positioned seat attachment bracket means having a centrally positioned tubular mounting and attachment sleeve and attachment means therefor for firm attachment to a corresponding intermediate portion of the longitudinal support member and with said attachment bracket also being provided with two transversely symmetrically spaced spring-mounting portions, a corresponding pair of spring means mounted thereon, and attachment means for attachment to an undersurface of the seat means whereby to effectively resiliently interpose the upward biasing force provided by said pair of seat spring means between the attachment bracket spring-mounting portions and the seat means in a manner allowing forced, upwardly spring-biased, downward deflection of said seat means relative to the attachment bracket.

OBJECTS OF THE INVENTION

With the above points in mind, it is an object of the present invention to provide a skating velocipede apparatus adapted to facilitate the high-speed skating propulsion of a skater along a smooth hard surface while in a seated position either part of the time or substantially all of the time.

It is a further object of the present invention to provide a novel skating velocipede apparatus of the character referred to herein, generally and/or specifically, which may include any or all of the features referred to herein, either individually or in combination, and which is of extremely easy-to-manufacture, easy-to-ship, easy-to-package and easy-to-use construction and which is capable of being manufactured in a variety of sizes, shapes, styles, qualities and price ranges, as needed, at relatively low cost, both as to the initial capital cost (including production set-up cost) and as to the subsequent per-unit manufacturing cost, whereby to be conducive to wide-spread production, distribution, sale and use of the novel apparatus of the present invention for the purposes outlined herein or any other substantially functionally equivalent purposes.

Further objects are implicit in the detailed description which follows hereinafter (which is to be considered as exemplary of, but not specifically limiting, the present invention), and said objects will be apparent to persons skilled in the art after a careful study of the detailed description which follows.

BRIEF DESCRIPTION OF THE DRAWINGS

FIG. 1 is a three-dimensional perspective view of one illustrative embodiment of the invention in a normal angular operative orientation relative to an underlying ground surface suitable for actual skating usage.

FIG. 2 is a fragmentary sectional view taken substantially along the plane and in the direction indicated by the arrows 2—2 of FIG. 1.

FIG. 3 is a fragmentary sectional view taken substantially along the plane and in the direction indicated by the arrows 3—3 of FIG. 1.

FIG. 4 is a fragmentary sectional view taken substantially along the plane and in the direction indicated by the arrows 4—4 of FIG. 1.

FIG. 5 is a fragmentary front elevational view taken in the direction of the arrows 5—5 of FIG. 1 and illustrates a representative portion of the handle means with a portion of one handle cover partially broken away.

FIG. 6 is a fragmentary sectional view taken substantially along the plane and in the direction indicated by the arrows 6—6 of FIG. 2 and shows one-half of the thigh-abutment means.

FIG. 7 is a fragmentary view taken substantially along the plane and in the direction indicated by arrows 7—7 of FIG. 3.

FIG. 8 is a fragmentary view of the brake attachment structure taken substantially along the plane and in the direction indicated by the arrows 8—8 of FIG. 1.

DESCRIPTION OF THE PREFERRED EMBODIMENTS

Figures 9, 10, 11, 12:
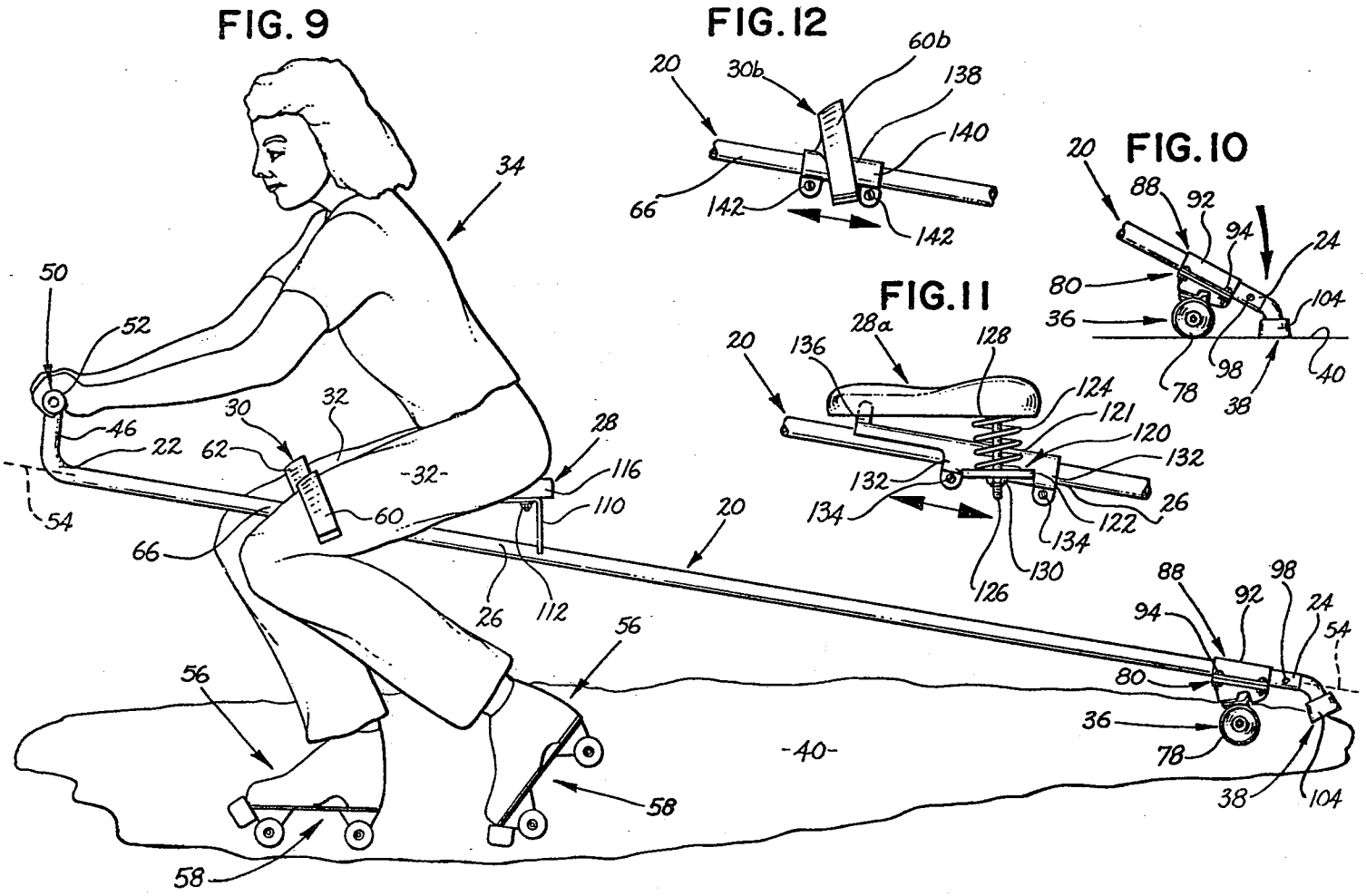
FIG. 9 is a side elevational view of the exemplary first form of the invention showing it in actual skating propulsion useage by a skater operating the apparatus.
FIG. 10 is a fragmentary side elevational view of the rear portion of the apparatus of FIG. 1, clearly illustrating the operation of the brake means.
FIG. 11 is a fragmentary side elevational view of a slightly modified form of seat means and structure for mounting same resiliently rather than rigidly as in the first form of the invention.
FIG. 12 is a fragmentary side elevational view of a slightly modified form of the thigh-abutment means showing a modified slideably adjustable and lockable mounting means therefor.

Generally speaking, the skating velocipede apparatus of the present invention comprises a structurally strong framework means, having at least one longitudinal support member, such as is generally designated by the reference numeral 20, having a front end 22 and a rear end 24 and an intermediate seat-supporting portion 26 positioned therebetween, and provided on the upper side thereof with seat means, such as is generally indicated at 28, adapted for use by a skater operating the skating velocipede apparatus. The longitudinal support member 20, in the example illustrated, is shown as comprising a structurally strong length of hollow tubing which provides a maximum strength-to-weight ratio, although the invention is not specifically so limited in all forms thereof. The longitudinal support member 20 is provided forwardly of the intermediate seat-supporting portion 26 with transversely extending thigh-receiving and thigh-abutment means, such as is generally designated at 30, and which is adapted to receive the thighs, such as shown at 32 in FIG. 9, of the skater, such as generally designated at 34 in FIG. 9, who is seated on the seat means 28 in a manner such that force is adapted to be exerted by the skater's thighs 32 upwardly and forwardly against the thigh-abutment means 30, wile force is exerted downwardly relative to the support member 20 by the weight of the skater 34 resting upon the seat means 28 carried by the support member 20 rearwardly of the thigh-abutment means 30. The above-described relationship of the skater 30 with respect to the seat means 28 and thigh-abutment means 30 causes the longitudinal support member 20 to function as an effective lever means, with the thigh-abutment means 30 comprising and functioning as an effective fulcrum means and with the rear end 24 being adapted to be forced downwardly and to comprise and function as an output end of the said effective lever means.

The rear end 24 of the support member 20 is provided with downwardly projecting wheel means, generally designated by the reference numeral 36, for downwardly forced contact with any smooth, hard underlying ground surface (which is intended to include any type of smooth underlying surface suitable for skating usage).

The rear end 24 of the support member 20 is also provided with an effectively downwardly directed frictional brake means, indicated generally at 38, at a location rearwardly displaced from the downwardly projecting wheel means 36, whereby to be controllably effectively moveable downwardly into forced braking contact with any smooth underlying hard ground surface, such as that shown diagramatically at 40 in FIG. 4 and FIG. 10, whenever the front end 22 of the support member 20 is forcibly manually lifted upwardly in a manual braking action in a direction such as is indicated diagramatically by the directional braking movement arrow 42, indicated in FIG. 1 and FIG. 9, which causes the reverse downward braking movement as indicated by the downward braking arrow 44 shown in FIG. 10.

In the preferred exemplary first form of the invention illustrated in FIGS. 1–10 inclusive, the front end 22 of the support member 20 is provided with a substantially upwardly extending neck portion 46, angularly related to the remainder of the longitudinal support member 20 (in the example illustrated, substantially prependicularly angularly related), with the neck portion 46 having an upper terminus 48 provided with a substantially transversely symmetrically mounted and extending manually graspable handle means, indicated generally at 50. In the first form illustrated, the manually graspable handle means 50 merely comprises a tubular cross bar which is preferably provided with frictional rubber slip-on handle end cover members 52 for facilitating the grasping and holding of the handle means 50.

The handle means 50 is adapted for forcibly performing the previously mentioned uplifting manual braking action in the direction of the braking arrow 42 of FIGS. 1 and 10 when desired and, additionally, is also intended for use as a steering control for the entire apparatus by manually applying torque, by way of the handle means 50, to a longitudinal axis of the rest of said longitudinal support member 20 (said coincident axes being indicated by a common broken-line axis indicated by the reference numeral 54 in FIG. 9). Said application of torque to the entire device around the axis 54 whenever the apparatus is to be turned, causes a corresponding tilting of the thigh-abutment means 30, the seat means 28, and the rear-positioned downwardly projecting wheel means 36 in a manner causing a corresponding turning movement of the entire apparatus relative to a forward direction of skating propulsion of the apparatus in response to conventional skating movements of a skater's legs 32 and a skater's skate-bearing feet, indicated generally at 56 in FIG. 9, while the skater 34 is seated on the seat means 28 in the general operative relationship illustrated in FIG. 9.

It should be understood that the skater's feet 56 are adapted to carry conventional roller skates 58 and that the skater 34 may perform conventional skating movements of the skates 58 relative to the underlying ground surface 40 while in the fully seated position shown in FIG. 9 or may do so while in a partially seated position or the skater may additionally partially or fully stand up for short periods of time while accelerating the movement of the entire apparatus in a conventional skating manner, after which the skater may re-seat himself upon the seat and continue propelling the apparatus forwardly by conventional skating movements of his legs and feet. Any or all of these modes of skating propulsion of the apparatus are contemplated and are intended to be included and comprehended within the broad scope of the present invention.

It will be understood that as long as the handle means 50 is positioned horizontally, the skater 34 and the entire apparatus will be skatingly propelled substantially forwardly, but as soon as the skater 34 leans in one sideward direction or the other, and correspondingly twists the handle 50, the skater and the entire apparatus will begin to turn in that direction, thus providing a very complete measure of control to the skater.

The thigh-abutment means 30 comprises a rearwardly and downwardly flat-surfaced convoluted structural member having a leftwardly and rearwardly concave portion 60, a rightwardly and rearwardly concave portion 62, and a centrally positioned, upwardly concave portion 64 adapted to receive therein an attachment portion 66 of the longitudinal support member 20, and with both of the portions 64 and 66 being provided with alignable aperture means and threaded fastener means, indicated generally at 72, for firmly attaching the thigh-abutment means 30 to the attachment portion 66 of the support member 20. In the example illustrated, the threaded fastener means may comprise a threaded bolt 74 and wing nut 76, although not specifically so limited.

Also, in the example illustrated, several sets of vertically aligned apertures may be provided along a part of the length of the attachment portion 66 of the support member 20 to make it possible to adjust the longitudinal position of the thigh-abutment means 30 for appropriate cooperation with thighs of various different lengths and girths.

In the exemplary first form of the invention illustrated, the downwardly projecting wheel means 36 comprises a pair of roller-bearing-mounted, laterally spaced, horizontally axially rotatively positioned skate wheel means 78 provided with, and attached to, a mounting attachment truck-bracket means, indicated at 80, comprising a metal attachment panel 82 and resilient, deflectible, elastomeric shock absorbing and deflectible mounting pad material 84 and an upper plate member adapted to be fastened to an upper attachment bracket, indicated generally at 88, lying over the top of a rear portion 90 of the longitudinal support member 20 and effectively defining, with said attachment truck-bracket means 80 positioned immediately therebelow, a constrictible longitudinal receiving clamping sleeve means, indicated by the reference numeral 92, adapted to be firmly locked onto said rear portion 90 of the support member 20 by multiple fastener means 94 with the wheel means 20 properly projecting downwardly therefrom in a suitable skating relationship.

The brake means, indicated at 38, is effectively provided with a controllably engageable or disengageable attachment means comprising a telescopic engaging member 96 adapted to be telescopically engaged with the extreme rear end 24 of the hollow tubular support member 20, and with both of same being provided with controllably fastenable locking means for removeably fastening said attachment means 96 in locked relationship to the rear end 24 of the support member 20 in the manner best shown in FIGS. 4 and 8. Said locking means is illustrated in one form wherein it comprises a threaded fastener, such as a bolt or the like, indicated at 98, adapted to extend through alignable holes 100 in the hollow rear end 24 of the support member 20 and through an alignable aperture 102 in the telescopic engaging member 96. Thus, the entire brake means 38 can be readily mounted and dismounted.

The brake means 38 is shown in a preferred form wherein it comprises a frictional braking element 104, preferably made of hard rubber or some other very wear-resistant, highly-frictional, material which is removeably attachable to a downwardly facing end surface portion 106 of the telescopic engaging member 96—in the example best shown in FIG. 4, by way of a countersunk threaded screw 107 lying in a bore 108, so that the head of the fastening screw 106 will not participate in the frictional braking engagement of the lower surface of the braking element 104 when forcibly moved into braking contact with the ground surface 40 in the manner specifically illustrated in FIG. 10. It will be understood that the fastening screw 107 makes it possible to readily remove and replace the frictional braking element 104 whenever it becomes excessively worn.

In the exemplary first form of the present invention, the intermediate seat-supporting portion 26 is provided with a seat-supporting attachment bracket 110, which is shown as being welded onto the upper surface of said seat attachment portion 26 thereof, but it may be otherwise attached thereto. Said bracket 110 is adapted to have the seat means 28 firmly attached to the top thereof by appropriate fastener means, such as are indicated at 112, which are representative only. The seat means 28 may, of course, have its upper surface appropriately padded by resilient pad means, such as is indicated at 114 and may be provided with suitable cover means 116.

In the preferred first form of the invention illustrated, the rearwardly, downwardly directed concave portions 60 and 62 of the thigh-abutment means 30 are provided with appropriate compressible resilient pad means, such as are indicated at 118.

FIG. 11 illustrates a slight modification of the seat means and the means for mounting or attaching same with respect to the seat supporting portion 26 of the longitudinal support member 20. Because it does illustrate a modification, the seat means is designated by the reference numeral **28*a* to indicate its correlation to the seat means 28 of the first form of the invention. The other portions of the apparatus which are not modified, such as the seat-supporting portion 26 and the longitudinal support member 20, are designated by the same reference numerals as in the first form of the invention, and new parts in the FIG. 11** modification are designated by new reference numerals.

In the modification of FIG. 11, the arrangement is such as to provide for resilient mounting of the seat means **28*a* rather than the relatively rigid mounting of the seat 28 in the first form of the invention. In the exemplary, but non-specifically limiting form shown in FIG. 11, this is accomplished by providing a symmetrically and transversely positioned seat attachment bracket means, such as is designated generally at 120, havng a centrally positioned tubular mounting and attachment sleeve 121 and attachment means therefor, such as the clamp means indicated at 132 and the threaded fastener means 134, whereby to provide for firm attachment of the sleeve 121 and the entire seat attachment bracket means 120 to a corresponding intermediate portion 26 of the longitudinal support member 20**.

In the example illustrated, the attachment bracket 120 is also provided with two transversely symmetrically spaced spring-mounting portions, such as the exemplary near one shown at 122 in FIG. 11, which is to be understood as being representative of a similar remote spring-mounting portion 122 positioned on the opposite side of the intermediate portion 26 of the longitudinal support member 20, and, therefore, not seen in the orientation of the apparatus shown in FIG. 11. The two transversely symmetrically spaced spring-mounting portions 122 are adapted to be effectively provided with attachment means for attaching same relative to the undersurface of the seat means. In the example illustrated, this is accomplished by the provision of two similar attachment bolts 126 spaced on opposite sides of the intermediate mounting portion 26 of the support member 20 and each firmly attached to the undersurface 128 of the seat means **28*a* and each extending downward through a corresponding hole or aperture in the corresponding spring-mounting portion 122 for free downward movement therethrough but being restrained against upward movement beyond a certain point by reason of the provision of a retaining nut 130 on the corresponding threaded end of the corresponding one of the two laterally spaced bolts 126. A further part of said attachment means is an individual coil compression spring means 124 centered on each of the two bolts 126 and thus comprising a pair of such seat-biasing spring means 124** similarly positioned on each side of the intermediate portion 26 of the support member 20. A further portion of said attachment means comprises a pivotal connection attachment of the undersurface 128 of the forward end of the seat 28*a* as indicated at 136. This provides an arrangement which allows the rear end of the seat means 28*a* to freely resiliently move downwardly under the load imposed thereon by a person's weight when seated thereon and, thus, may provide a more comfortable seating arrangement than that provided by the seat means 28 of the first form of the invention. Furthermore it should be noted that the resilient seat means 28*a*, and the mounting structure therefor illustrated in FIG. 11, is readily positionally adjustable along the longitudinal support member 20 by loosening the effective clamp means 132 at each end of the attachment sleeve means 121 so that it can be slidably moved into a desired location and then firmly and rigidly tightening same in place by tightening the threaded fastener means 134. It should also be noted that any desired type of non-round or effective key means may be provided at any location relative to the inner-surface of the attachment sleeve 121 and clamps 132 and relative to the outer-surface of the intermediate seat supporting portion 26 of the support member 20 for the purpose of firmly and non-rotatively locking the seat means 28*a* in place thereof in any desired adjusted location.

FIG. 12 illustrates a further slight modification of the invention wherein the thigh-abutment means is designated generally by the reference numeral 30*b* and comprises a left and right downwardly and rearwardly concave portion similar to those shown at 60 and 62 of the first form of the invention illustrated in FIG. 1. However, since FIG. 12 is a direct left side elevational view, only the left downwardly and rearwardly concave portion of the thigh-abutment means 30*b* can be seen and it is designated by the reference numeral 60*b*. It should be clearly understood that it is representative of the opposite unseen right downwardly and rearwardly concave portion which cannot be seen in FIG. 12. The old portions of the apparatus are designated by the same reference numerals as employed in describing and illustrating the first form of the invention and new portions in the FIG. 12 modification are designated by new numbers.

It will be noted that the intermediate connection portion effectively comprises an at least partial connection ring, such as is designated by the reference numeral 138 in the form of a ring of some length such as to in effect comprise a split sleeve which is adapted to be threaded onto, or otherwise moved into, a position on the longitudinal support member 20 at the attachment location 66 in closely encircling relationship. The modified arrangement of FIG. 12 is also provided with controllably operable locking means comprising the clamping means 140 and the threaded fastener means 142 which can be firmly tightened so as to lock the entire thigh-abutment means 30*b* at any selected adjusted location along the attachment portion 66 of the longitudinal support member 20. This makes it possible to compensate for any variations in thigh length of any individual who may use the skating velocipede apparatus. It should also be noted that, in a manner similar to the previous description, the modified adjustable thigh-abutment means 30*b* of FIG. 12 may have its mounting sleeve or ring 138 and/or its clamp means 140 inwardly provided with non-round or key means for cooperation with similar non-round or key means which may be externally carried by the attachment portion 66 of the longitudinal support member 20. This would provide for positive non-rotative mounting of the thigh-abutment means 30*b* on the attachment portion 66 of the support member 20.

It should be understood that the figures and the specific description thereof set forth in this application are for the purpose of illustrating the present invention and are not to be construed as limiting the present invention to the precise and detailed specific structures shown in the figures and specifically described hereinbefore. Rather, the real invention is intended to include substantially equivalent constructions embodying the basic teachings and inventive concept of the present invention.

What is claimed is:

1. A skating velocipede apparatus to facilitate high speed skating propulsion of a skater along a smooth hard ground surface while in a seated position, comprising: structurally strong framework means including at least one longitudinal support member having a front end and a rear end and an intermediate seat-supporting portion positioned therebetween, said intermediate seat-supporting portion being provided on an upper side thereof with seat means for a skater operating the skating velocipede apparatus to sit upon, said longitudinal support member being provided forwardly of said intermediate seat-supporting portion with transversely extending thigh-receiving thigh-abutment means adapted to receive the thighs of a skater who is seated on the seat means in a manner such that force is adapted to be exerted by the skater's thighs upwardly and forwardly against said thigh-abutment means while force is exerted downwardly relative to said support member by the weight of the skater resting upon said means carried by said support member rearwardly of said thigh-abutment means, thus causing said longitudinal support member to comprise and function as an effective lever means, with said thigh-abutment means comprising and functioning as an effective fulcrum means, and with said rear end being adapted to be forced downwardly and to comprise and function as an output end of said effective lever means; said rear end of said longitudinal support member being provided with downwardly projecting wheel means for downwardly forced contact with a smooth hard underlying ground surface; said rear end of said longitudinal support member being provided with an effectively downwardly directed frictional brake means at a location rearwardly displaced beyond said downwardly projecting wheel means whereby to be controllably effectively pivotally moveable downwardly into forced braking contact with an underlying smooth hard-ground surface whenever the front end of said longitudinal support member is forcibly manually lifted upwardly in a manual braking action, said front end of said longitudinal support member being rigidly provided with a three-axes-torque-applying positional orientation control means comprising a substantially upwardly extending neck portion rigidly angularly related to the remainder of said longitudinal support member and having an upper terminus rigidly provided with a substantially transversely symmetrically mounted and extending manually graspable rigid handle means for use in forcibly performing said uplifting manual braking action when desired and effectively applying torque around a transverse axis of rotation substantially coincident with said thigh-abutment means and, alternatively, for use in response to the application of torque manually applied thereto around a longitudinal axis of rotation substantially coincident with the longitudinal axis of the rest of said longitudinal support member, and of torque manually applied, thereto around a vertical axis of rotation substantially coincident with said neck portion, to cause corresponding tilting of said thigh-abutment means, said seat means, and said rear-positioned, downwardly-projecting wheel means in a manner causing a corresponding turning movement of the entire apparatus relative to a forward direction of skating propulsion of the apparatus in response to conventional skating movements of a skater's legs and skate-bearing feet while seated on the seat means and while having his thighs engaged by said thigh-abutment means.

2. A skating velocipede apparatus as defined in claim 1, wherein said thigh-receiving thigh-abutment means comprises a rearwardly and downwardly flat-surfaced convoluted structural member having a left downwardly and rearwardly concave portion, a right downwardly and rearwardly concave portion, and a centrally-positioned upwardly concave portion adapted to receive therein an attachment portion of said longitudinal support member and with both of the same being provided with alignable aperture means and threaded fastener means for firmly attaching said thigh-receiving thigh-abutment means to said attachment portion of said longitudinal support member.

3. A skating velocipede apparatus as defined in claim 1, wherein said thigh-receiving thigh-abutment means comprises a rearwardly and downwardly flat-surfaced thin multi-curved bar member having a left downwardly and rearwardly concave portion, a right downwardly and rearwardly concave portion and an intermediate connection portion provided with a connection ring adapted to be threaded onto said longitudinal support member and slidably moved to an attachment location closely encircling an attachment portion thereof and being provided with controllably operable locking means for firmly locking said connection ring relative to said attachment portion of said longitudinal support member at a proper thigh-receiving effective fulcrum location.

4. A skating velocipede apparatus as defined in claim 1, wherein said downwardly projecting wheel means comprises a pair of roller-bearing-mounted, laterally spaced, horizontally axially rotatively positioned, skate wheel means provided with and attached to a mounting attachment truck-bracket means, and further provided with an upper attachment bracket lying over the top of a rear portion of said longitudinal support member and effectively defining with said attachment truck-bracket means positioned immediately therebelow a constrictible longitudinal receiving clamping sleeve means having said rear portion of said longitudinal support member extending therethrough and provided with an adjustable fastening means for firmly fastening said upper and lower clamping sleeve means and attachment truck-bracket means and firmly locked onto said rear portion of said longitudinal support member with said wheel means projecting downwardly therefrom.

5. A skating velocipede apparatus as defined in claim 1, wherein said braking means is effectively provided with a controllably engageable and disengageable attachment means comprising a telescopical engaging member adapted to be telescopically engaged with the extreme rear end of said longitudinal support member and provided with controllably fastenable locking means for removeably fastening said attachment means in locked relationship.

6. A skating velocipede apparatus as defined in claim 5, wherein said brake means attachment means is provided with a frictional braking element removeably attachable in a downwardly facing position with respect to said engaging member and provided with controllably fastenable and unfastenable fastening means for same for facilitating the ready removal and interchanging of said frictional braking element after it has become excessively worn from repeated braking engagement against an underlying hard ground surface.

7. A skating velocipede apparatus as defined in claim 5, wherein said attachment means is provided with a frictional braking element removeably attachable to a downwardly facing attachment surface and having countersunk threaded fastener means for fastening same together and for facilitating removal and the interchanging of said braking element after it has become excessively worn from repeated braking action against an underlying hard ground surface.

8. A skating velocipede apparatus as defined in claim 1, wherein said intermediate seat-supporting portion of said longitudinal support member is provided with a seat-supporting attachment bracket fastened thereto having spaced attachment means adapted to underlie said seat means and effectively provided with attachment means for fastening said seat means thereto.

9. A skating velocipede apparatus as defined in claim 1, wherein said intermediate seat-supporting portion is provided with symmetrically transversely positioned seat attachment bracket means having centrally positioned tubular mounting and attachment sleeve and attachment means therefor for firm attachment to a corresponding intermediate portion of said longitudinal support member and with said atachment bracket also being provided with two transversely symmetrically spaced spring-mounting portions, a corresponding pair of spring means mounted thereon, and attachment means for attachment to an under surface of said seat means, whereby to effectively resiliently interpose the upward biasing force provided by said pair of seat spring means between said attachment bracket spring-mounting portions and said seat means in a manner allowing forced, upwardly-spring-biased, downward deflection of said seat means relative to said attachment bracket.

* * * * *